US009566695B2

(12) United States Patent
Rajotte

(10) Patent No.: US 9,566,695 B2
(45) Date of Patent: Feb. 14, 2017

(54) SCREW DRIVING DEVICE WITH ADJUSTABLE COUNTERSINK DEPTH

(71) Applicant: Jacques Rajotte, Hood River, OR (US)

(72) Inventor: Jacques Rajotte, Hood River, OR (US)

( * ) Notice: Subject to any disclaimer, the term of this patent is extended or adjusted under 35 U.S.C. 154(b) by 271 days.

(21) Appl. No.: 14/491,998

(22) Filed: Sep. 20, 2014

(65) Prior Publication Data

US 2015/0122089 A1 May 7, 2015

(30) Foreign Application Priority Data

Nov. 4, 2013 (CA) ..... 2831764

(51) Int. Cl.
*B25B 23/14* (2006.01)
*B25B 23/00* (2006.01)
*B25B 21/00* (2006.01)

(52) U.S. Cl.
CPC ..... *B25B 21/007* (2013.01); *B25B 23/0035* (2013.01); *B25B 23/0064* (2013.01)

(58) Field of Classification Search
CPC ..... B25B 23/141; B25B 23/0035; B25B 23/0064; B25B 21/007
USPC ..... 81/429
See application file for complete search history.

(56) References Cited

U.S. PATENT DOCUMENTS 4,647,260 A * 3/1987 O'Hara ..... B25B 21/00 408/113
5,380,132 A * 1/1995 Parks ..... B25B 23/0064 408/113
5,996,452 A 12/1999 Chiang
6,520,509 B1 * 2/2003 Vasudeva ..... B23B 31/1071 279/14
7,387,054 B2 * 6/2008 Rajotte ..... B25B 15/001 279/75
7,810,414 B2 * 10/2010 Hsu ..... B25B 23/0064 81/429
8,016,605 B2 * 9/2011 Montena ..... H01R 13/622 439/322

OTHER PUBLICATIONS

Requisition by Canadian Examiner dated Dec. 23, 2014 (3 Pages).

* cited by examiner

*Primary Examiner* — Hadi Shakeri

(57) ABSTRACT

A screw driving device with adjustable countersink depth has a resilient depth adjustment sleeve that permits a depth to which a screw is driven by the device to be adjusted by rotation of the resilient depth adjustment sleeve. Rotation of the resilient depth adjustment sleeve is impeded by engagement of a detent in elongated axial stop grooves in an interior wall of the resilient depth adjustment sleeve so that an adjusted position is not lost during normal use.

13 Claims, 8 Drawing Sheets

SCREW DRIVING DEVICE WITH ADJUSTABLE COUNTERSINK DEPTH

FIELD OF THE INVENTION

The present invention relates to a screw driving device and, in particular, a screw driving device which is adjustable to control the depth at which a screw is driven into a work piece.

BACKGROUND OF THE INVENTION

Conventional devices for driving screws using a power tool, such as an electric drill or an impact driver, are well known in the art. Such devices have a driveshaft end that is attached to the drive mechanism of the power tool and a screw driving head with a screw bit tip that engages the head of a screw. Screw driving heads now include devices with drive mechanisms that allow a screw to be countersunk at or below the surface of a work piece. For example, a clutch system may disengage the driveshaft to stop the bit from turning when a predetermined countersink depth is achieved. At the predetermined countersink depth, rotation of the screw bit ceases and the driving of the screw stops.

One disadvantage with most prior screw driving heads is that the countersink depth is fixed, or may be adjusted only by changing the screw bit because the countersink depth is determined by the length of the screw bit itself. As understood by those skilled in the art, screw bits are generally not available in small length increments, so countersink depth adjustment in such devices is impractical. Consequently, screw driving devices with depth adjustment have been invented.

One such screw driving device is adjusted by performing a series of steps. First, an outer collar is unscrewed from a nozzle. Next, both the outer collar and nozzle are moved axially by rotating each separately to achieve a desired counter sink depth. Finally, the outer collar is tightened down on the nozzle to lock the screw driving device at the desired counter sink depth. Manufacturers of such tools include Black & Decker, DeWalt, Roby, Milwaukee, etc.

Another such adjustable screw driving device is described in U.S. Pat. No. 4,647,260, which teaches a depth-adjusting subassembly connected to a nose portion of a power tool. An incremental rotation of a depth-adjustment collar of the depth-adjusting subassembly form one angular position to another relative to a nose portion of the power tool produces an axial movement of a dept locator to adjust a depth setting of the depth-adjusting subassembly. While simple to adjust, the depth-adjusting subassembly requires a plurality of precision parts.

It is therefore an object of the invention to provide a screwing device with an adjustable countersink depth that is simple to construct and to operate.

SUMMARY OF THE INVENTION

The invention therefore provides a screw driving device with adjustable countersink depth, comprising: a drive shaft having a drive end adapted to be engaged and driven by a power tool and a socket end with an annular wall that forms a socket which receives and retains a screw bit, the annular wall having a plurality of radial through bores which respectively receive a clutch ball bearing that engages the screw bit in a drive position and disengages the screw bit in a clutched position; a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective clutch ball bearings when the drive shaft is in the clutched position so that the clutch ball bearings disengage the screw bit but remain captured in the respective radial through bores, and further having a pin thread on an outer surface of the bottom end and at least two spaced-apart detents located above the pin thread; and a resilient depth adjustment sleeve that surrounds the bottom end of the hollow clutch sleeve, the resilient depth adjustment sleeve having a bottom end with a passage through which the screw bit extends and a box thread above the passage that engages the pin thread on the hollow clutch sleeve, and further having a plurality of elongated stop grooves respectively sized to engage one of the detents on the outer surface to the hollow clutch sleeve, so that rotational force applied to the resilient depth adjustment sleeve deforms the resilient depth adjustment sleeve to permit ridges between the stop grooves to pass over the detents to change a depth to which a screw is driven by the screw bit before the screw bit reaches the clutched position.

The invention further provides a resilient depth adjustment sleeve for a screw driving device with adjustable countersink depth, the resilient depth adjustment sleeve surrounding a bottom end of a hollow clutch sleeve of the screw driving device and having a bottom end with a passage through which a screw bit extends and a box thread above the passage that engages a pin thread on an outer bottom surface of the hollow clutch sleeve, and further having a plurality of elongated stop grooves respectively sized to engage a detent on the outer surface to the hollow clutch sleeve, so that rotational force applied to the resilient depth adjustment sleeve deforms the resilient depth adjustment sleeve to permit ridges between the stop grooves to pass over the detent to change a depth to which a screw is driven by the screw bit before the a drive shaft of the screw driving device reaches a clutched position in which the drive shaft rotates freely with respect to the screw bit of the screw driving device.

The invention yet further provides a screw driving device with adjustable countersink depth, comprising: a drive shaft having a drive end adapted to be engaged and driven by a power tool and a socket end with an annular wall that forms a socket which receives and retains a screw bit, the annular wall having a plurality of radial through bores which respectively receive a clutch ball bearing that engages the screw bit in a drive position and disengages the screw bit in a clutched position to permit the drive shaft to rotate freely with respect to the screw bit in the clutched position; a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective clutch ball bearings when the drive shaft is in the clutched position so that the clutch ball bearings disengage the screw bit but remain captured in the respective radial through bores, and further having a pin thread on an outer surface of the bottom end and a detent located above the pin thread; a resilient depth adjustment sleeve that surrounds the bottom end of the hollow clutch sleeve, the resilient depth adjustment sleeve having a bottom end with a passage through which the screw bit extends and a box thread above the passage that engages the pin thread on the hollow clutch sleeve, and further having a plurality of elongated stop grooves respectively sized to engage the detent on the outer surface to the hollow clutch sleeve, so that rotational force applied to the resilient depth adjustment sleeve deforms the resilient depth adjustment sleeve to permit ridges between the stop grooves to pass over the detents to change a depth to which a screw is driven by the screw bit before the drive shaft reaches the clutched position; and, a compression coil spring between the bottom end of the resilient depth adjustment sleeve and a bottom end of the drive shaft, the compression coil spring surrounding the screw bit and urging the drive shaft to the drive position.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
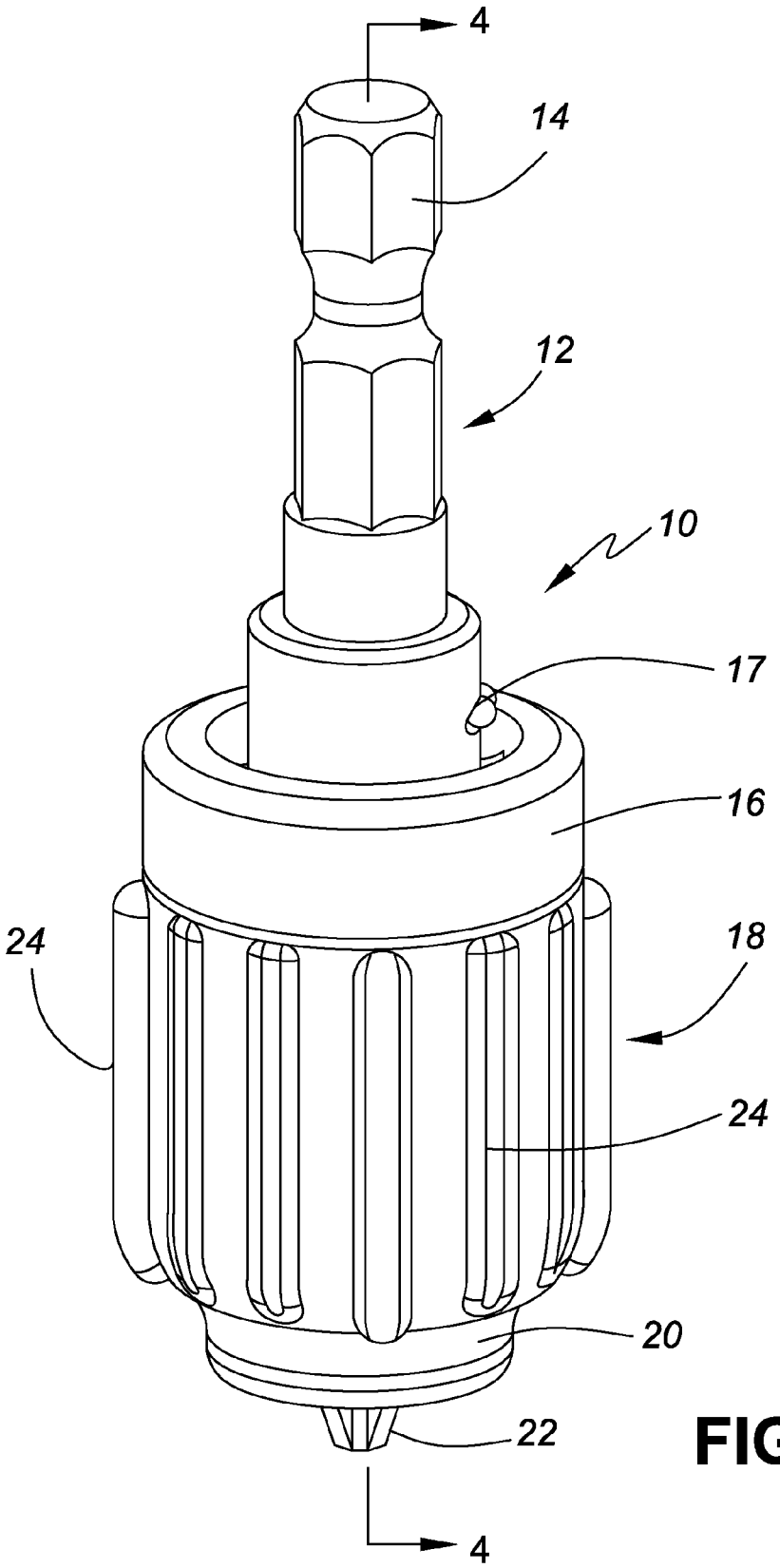
FIG. 1 is a perspective view of one embodiment of a screw driving device with adjustable countersink depth in accordance with the invention.

FIG. 1 is a perspective view of one embodiment of a screw driving device 10 with adjustable countersink depth in accordance with the invention. The screw driving device 10 has a drive shaft 12 with a drive end 14 adapted to be engaged and driven by a power tool, such as an electric power drill or impact driver, both of which are well known in the art. A hollow clutch sleeve 16 receives the drive shaft 12. A lock boss 17 is formed on a side of the drive shaft 12 to lock the screw driving device 10 in a locked position, as will be explained below with reference to FIG. 6. A resilient depth adjustment sleeve 18 surrounds a bottom end of the hollow clutch sleeve 16, the resilient depth adjustment sleeve having a bottom end 20 through which a screw bit 22 received in a bottom end of the drive shaft 12 extends. As will be explained below with reference to FIGS. 3-6, the screw bit 22 rotates with the drive shaft 12 when the screw driving device 10 is in a drive position and is released from driving engagement with the drive shaft 12 when the screw driving device 10 is in a clutched position. Rotation of the resilient depth adjustment sleeve permits a depth to which a screw is driven by the screw driving device 10 to be changed, as will be explained below with reference to FIGS. 7 and 8. Axial ribs 24 on the resilient depth adjustment sleeve 18 provide a gripping aid to facilitate manual rotation of the resilient depth adjustment sleeve 18 to adjust the depth to which the screw is driven.

Figure 2:
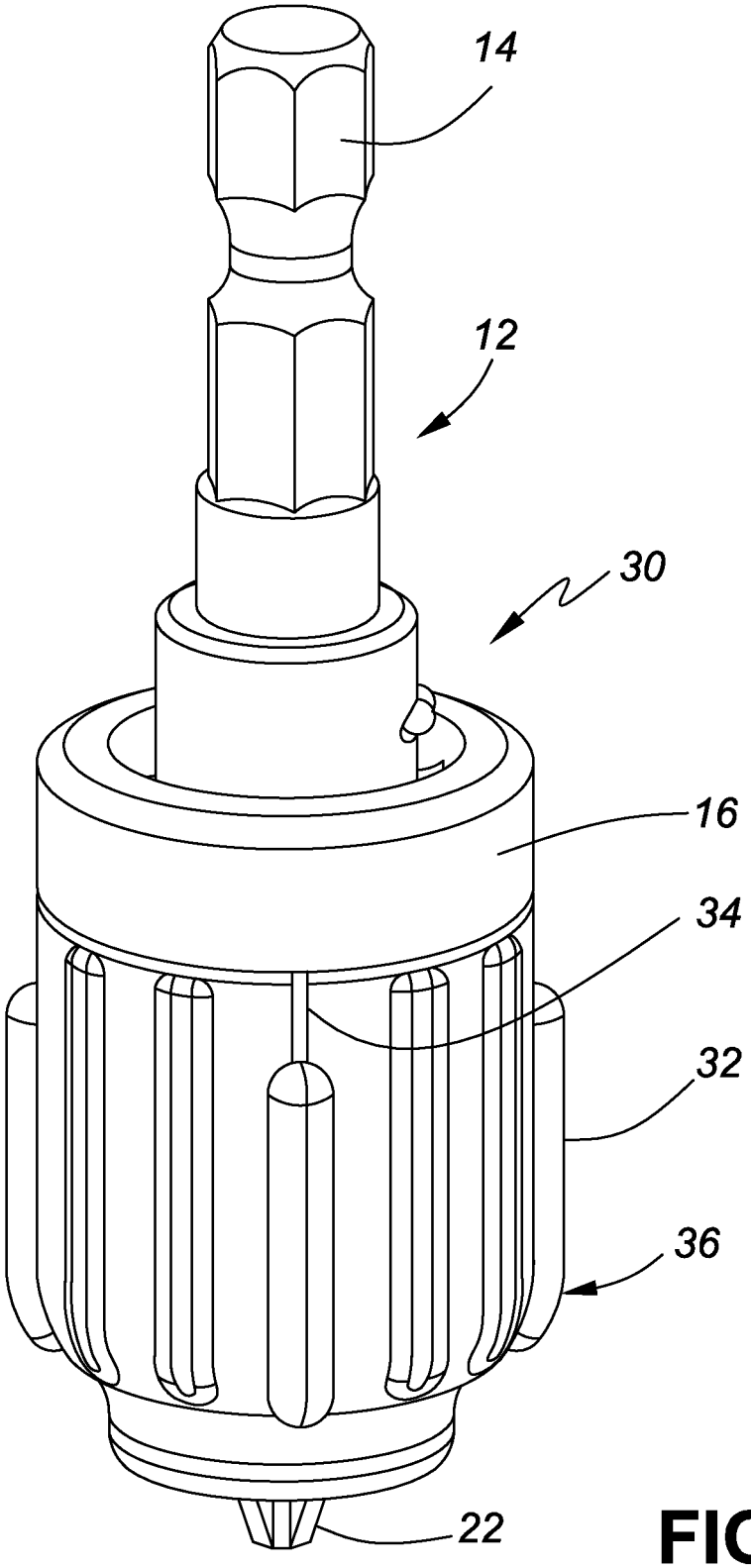
FIG. 2 is a perspective view of another embodiment of the screw driving device in accordance with the invention.

FIG. 2 is a perspective view of another embodiment 30 of the screw driving device in accordance with the invention. The screw driving device 30 is identical to the screw driving device 10 described above, except that certain ones of the axial ribs (axial ribs 32) do not extend all the way to a top end of a resilient depth adjustment sleeve 36. Rather, those axial ribs 32 extend only to a bottom of short axial slots 34 that increase a flexibility of the resilient depth adjustment sleeve 36. One embodiment of the screw driving device 30 includes four short axial ribs 32 and four short axial slots 34 in the resilient depth adjustment sleeve 36.

Figure 3:
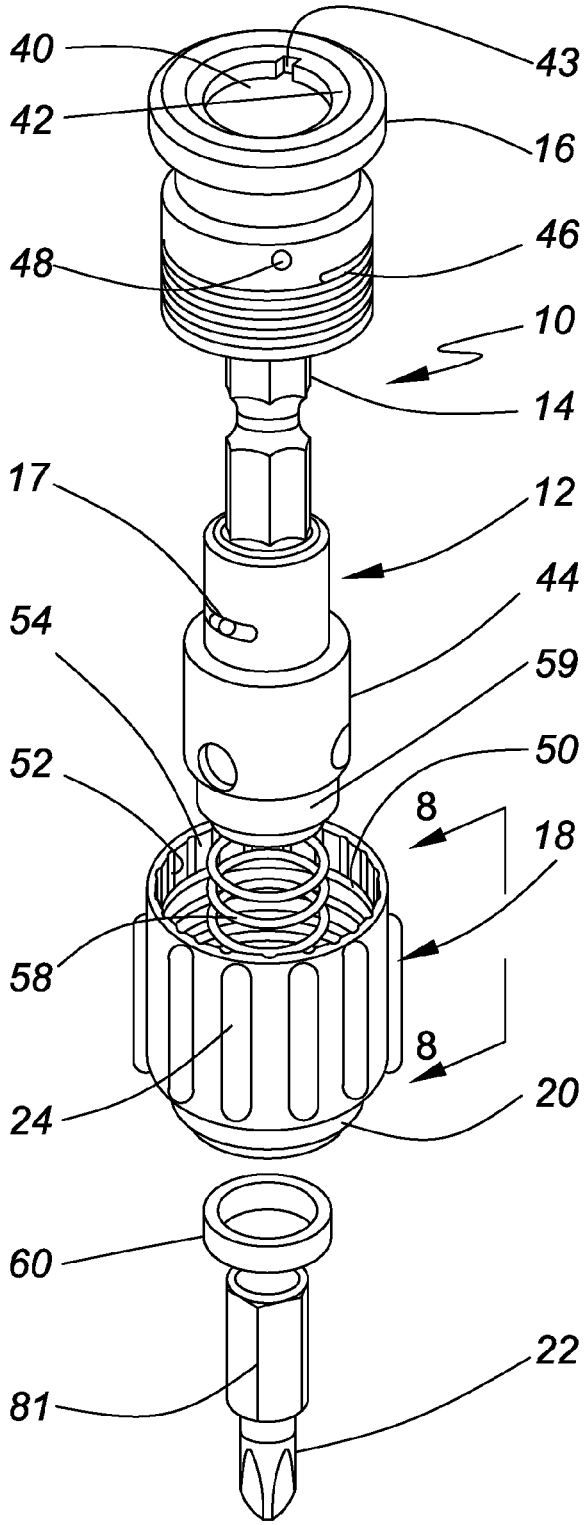
FIG. 3 is an exploded view of the screw driving device shown in FIG. 1.

FIG. 3 is an exploded view of the screw driving device 10 shown in FIG. 1. The drive end 14 of the drive shaft 12 extends through a central passage 40 in the hollow clutch sleeve 16. A top of the central passage 40 extends inwardly to form a stop 42 sized to permit the drive end 14 of the drive shaft 12 to pass through, but not permit a socket end 44 of the drive shaft 12 to pass through. A lock gap 43 in the stop 42 permits the lock boss 17 to pass through to lock the screw driving device in the locked position, which as noted above will be explained below with reference to FIG. 6. The hollow clutch sleeve 16 also has a pin thread 46 on an outer surface of the bottom end. At least one detent 48 is located above the pin thread 46. In one embodiment there are two opposed detents 48 (only one of which is shown in this view), which are small steel ball bearings that are friction fit within opposed radial bores in the hollow clutch sleeve 16. The resilient depth adjustment sleeve 18 has a box thread 50 that is shown more clearly in FIG. 8. The box thread 50 engages the pin thread 46 on the hollow clutch sleeve 16. The resilient depth adjustment sleeve 18 further has a plurality of elongated stop grooves 52 respectively sized to engage the detent(s) 48 on the outer surface to the hollow clutch sleeve 16, so that manual rotational force applied to the resilient depth adjustment sleeve 18 causes deformation of the resilient depth adjustment sleeve 18 to force ridges 54 between the elongated stop grooves 52 to slide over the detent(s) 48 to change a depth to which a screw is driven by the screw bit 22 before the screw driving device 10 reaches the clutched position.

A top end of a coil spring 58 encircles a bottom end 59 of the drive shaft 12 and a bottom end of the coil spring 58 engages an inner bottom surface of the resilient depth adjustment sleeve 18, as shown more clearly in FIGS. 4-7. The coil spring 58 urges the drive shaft 12 to the drive position. A doughnut-shaped magnet 60 is received in a socket 62 (see FIG. 4) in the bottom end 20 of the resilient depth adjustment sleeve 18. The magnet 60 magnetically attracts a steel screw (not shown) placed on the screw bit 22 so that the screw remains on the screw bit 22 until the screw is driven.

Figure 4:
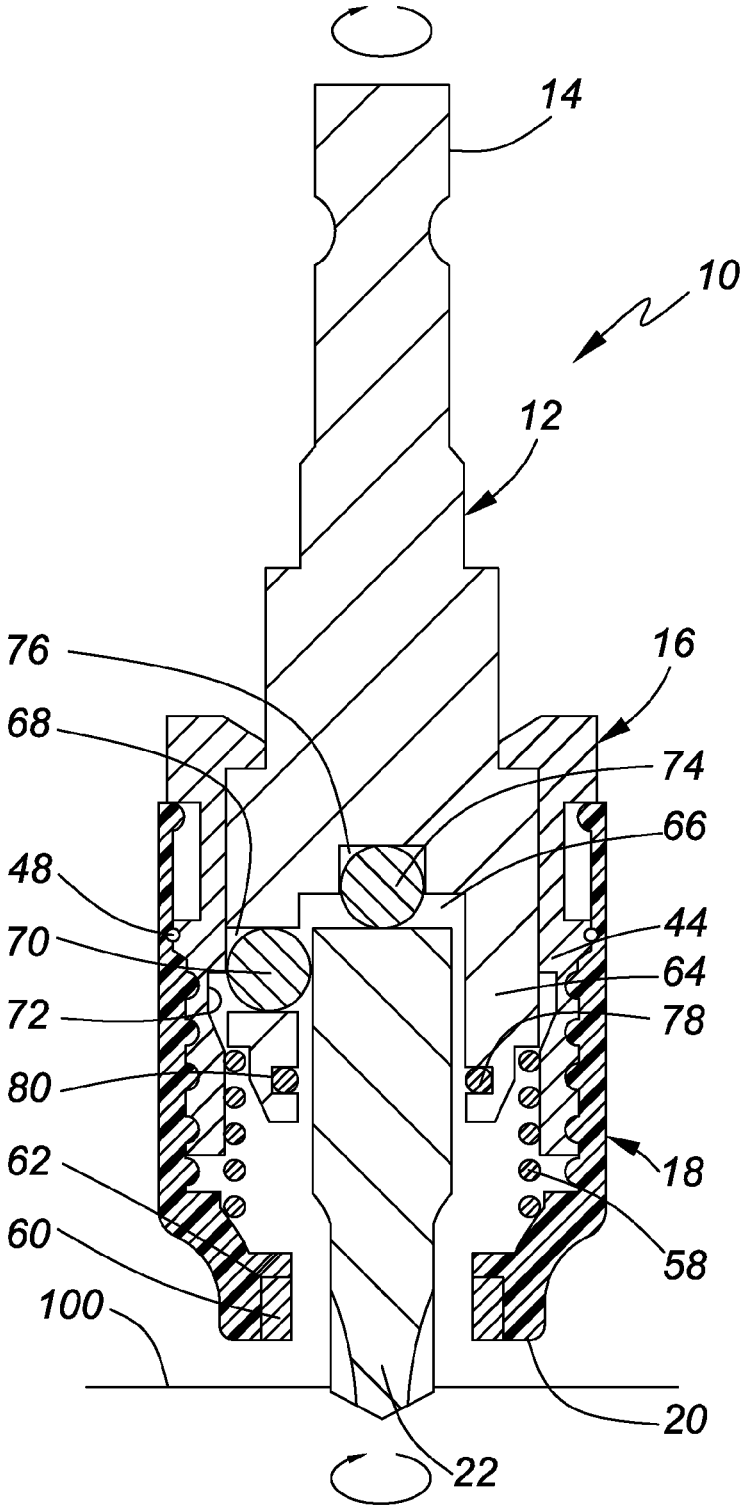
FIG. 4 is a cross-sectional view taken along lines 4-4 of the screw driving device shown in FIG. 1 in a drive position.

FIG. 4 is a cross-sectional view taken along lines 4-4 of the screw driving device 10 shown in FIG. 1 in the drive position in which rotation of the drive shaft 12 rotates the screw bit 22. The socket end 44 of the drive shaft 12 has an annular wall 64 that forms a socket 66 which receives and retains the screw bit 22, the annular wall 64 is pierced by a plurality radial through bores 68 (only one is shown in the cross-section, but typically there are three through bores 68). The radial through bores 68 respectively receive a clutch ball bearing 70 that engages a flat on the hexagonal screw bit 22 when the screw driving device 10 is in the drive position shown, and disengages the screw bit 22 in a clutched position shown in FIG. 5. The hollow clutch sleeve 16 has an annular groove 72 in a bottom end of the central passage 40 sized to receive the respective clutch ball bearings 70 when the screw driving device 10 is in the clutched position, so that the clutch ball bearings 70 disengage the screw bit 22 but remain captured in the respective radial through bores 68. A ball bearing 74 friction fit in an axial bore 76 supports a top end of the screw bit 22 to permit the screw bit 22 to remain stationary while the drive shaft 12 rotates freely when the screw driving device 10 is in the clutched position, as will be explained below with reference to FIG. 5. A circlip 78 captured in a radial groove 80 in the end of the socket 66 engages notches 81 (see FIG. 3) in the screw bit 22 to removably retain the screw bit 22 in the socket 66.

Figure 5:
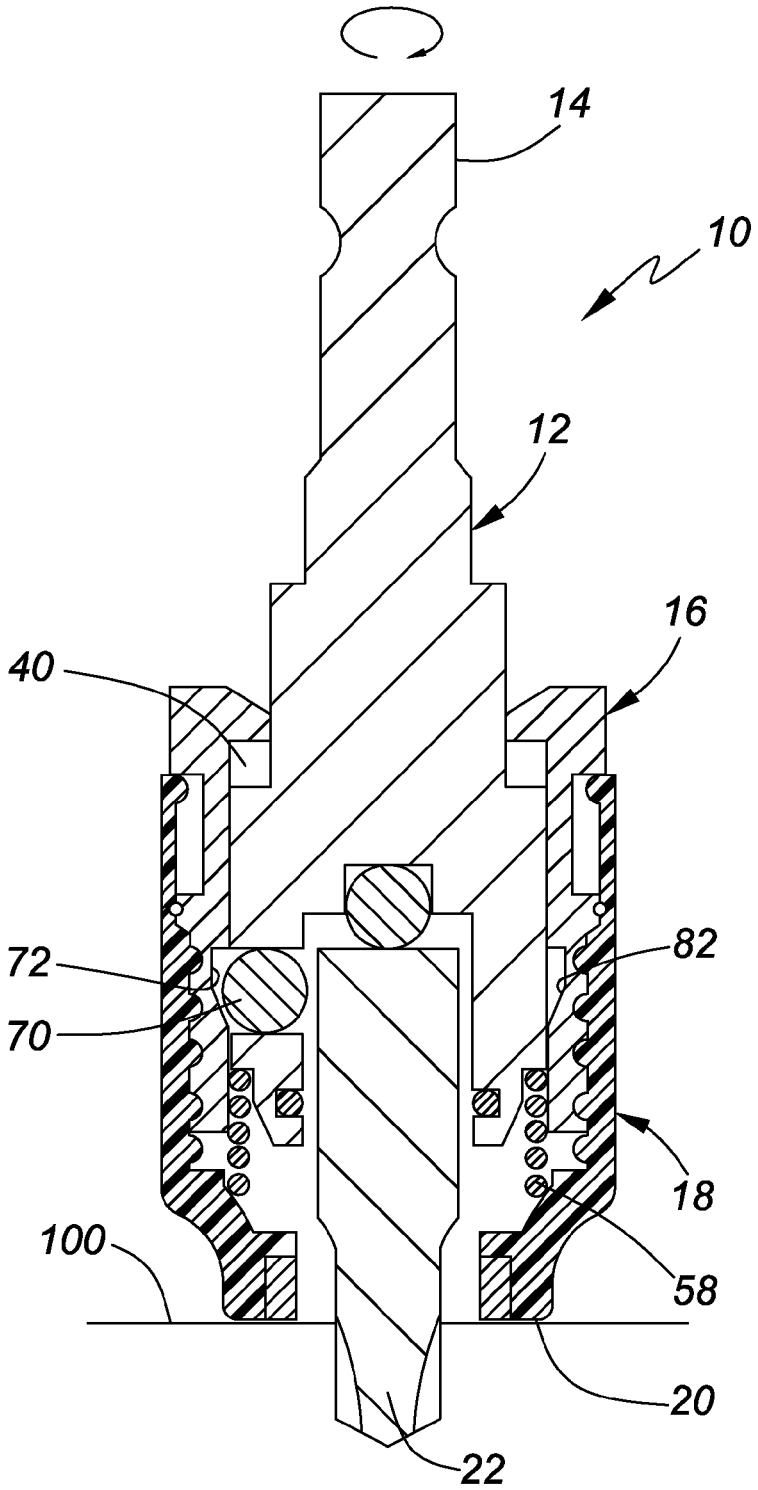
FIG. 5 is a cross-sectional view of the screw driving device shown in FIG. 4 in a clutched position.

FIG. 5 is a cross-sectional view of the screw driving device 10 shown in FIG. 4 in the clutched position in which the screw bit 22 is released from driving engagement with the respective clutch ball bearings 70 so that a screw is no longer driven by the screw driving device 10. As a screw is driven into a work surface 100, the bottom end 20 of the resilient depth adjustment sleeve contacts the work surface 100 and the drive shaft 12 slides downward through the central passage 40 of the hollow clutch sleeve 16 as the screw is driven into the work surface 100 until the respective radial through bores 68 align with the annular groove 72 in the hollow clutch sleeve 16 and the respective clutch ball bearings 70 are forced outwardly into the annular groove 72 by pressure exerted by the screw bit 22 as it engages the driven screw. Once the respective clutch ball bearings 70 enter the annular groove 72, they are no longer in contact with the respective flats on the screw bit 22 and the screw driving device 10 is in the clutched position. Thus, even though the drive shaft 12 may continue to be rotated by a power tool, the screw bit remains stationary and the screw is no longer driven. The depth to which the screw is driven into the work surface 100 is thereby controlled by the resilient depth adjustment sleeve 18. When downward pressure on the drive shaft 12 is released by an operator of the power tool, and the screw driving device 10 is moved away from the work surface 100, the coil spring 58 urges the drive shaft 12 upwardly and the screw driving device 10 returns to the drive position shown in FIG. 4. As the screw driving device 10 returns to the drive position, an inclined bottom surface 82 of the annular groove 72 forces the respective clutch ball bearings 70 back into contact with respective flats of the screw bit 22.

Figure 6:
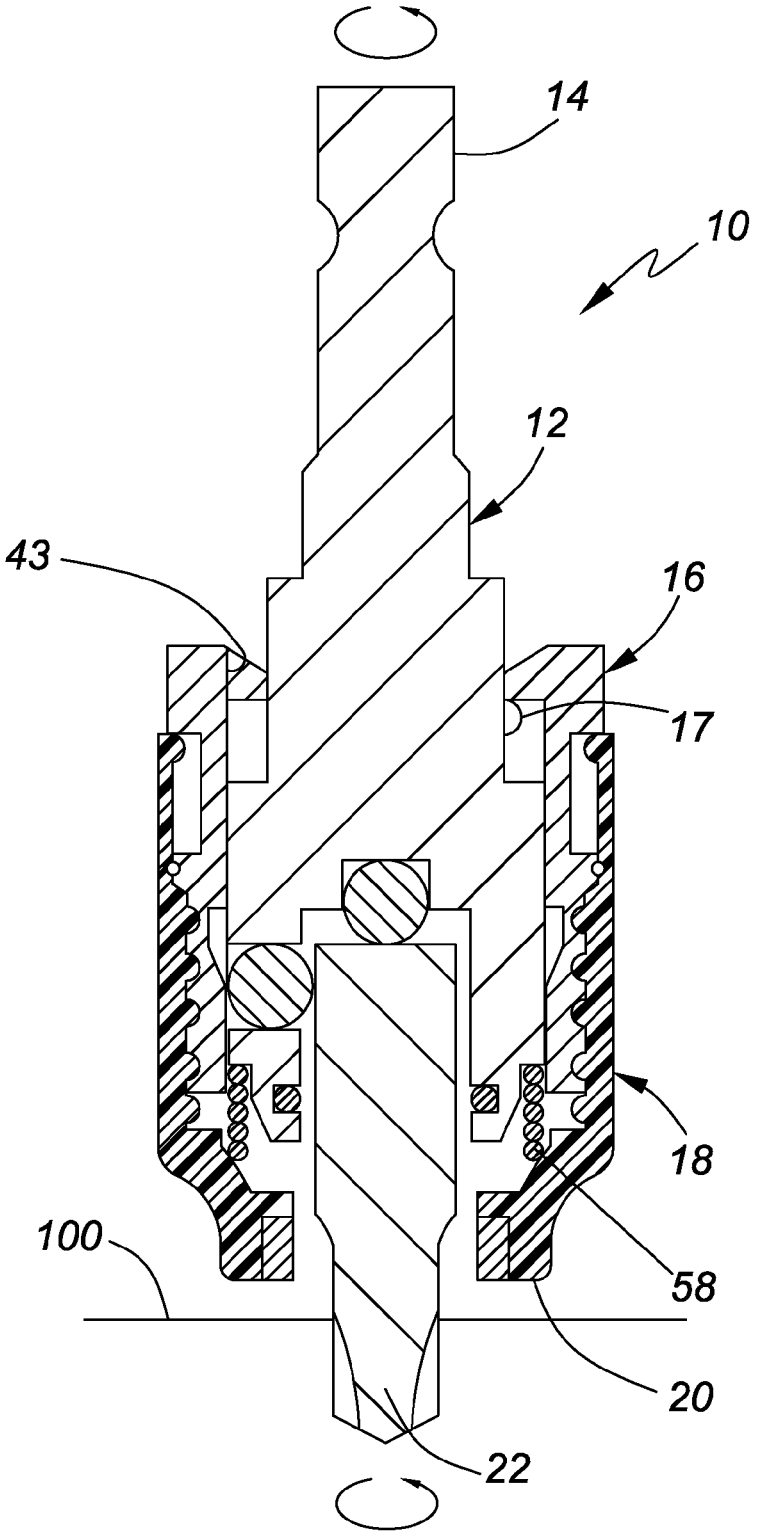
FIG. 6 is a cross-sectional view of the screw driving device shown in FIG. 4 in a locked position used to extract a driven screw.

FIG. 6 is a cross-sectional view of the screw driving device 10 shown in FIG. 4 in a locked position typically used to extract a driven screw. In order to place the screw driving device 10 in the locked position, the lock boss 17 is forced downwardly against the pressure of the coil spring 58 through the lock gap 43, described above with reference to FIG. 3, and the hollow clutch sleeve is rotated far enough to capture the lock boss 17 below the stop 42 at the top end of the hollow clutch sleeve 16. In this position, the respective clutch ball bearings 70 are below the annular groove 72 in the hollow clutch sleeve 16 and engage respective flats on the screw bit 22, so that rotation of the drive shaft 12 in either direction rotates the screw bit in the same direction. The screw driving device 10 is returned to the drive position show in FIG. 4 by turning the hollow clutch sleeve 16, while holding the drive shaft 12 stationary, until the lock boss 17 aligns with the lock gap 43 and is forced upwardly there through by the coil spring 58.

Figure 7:
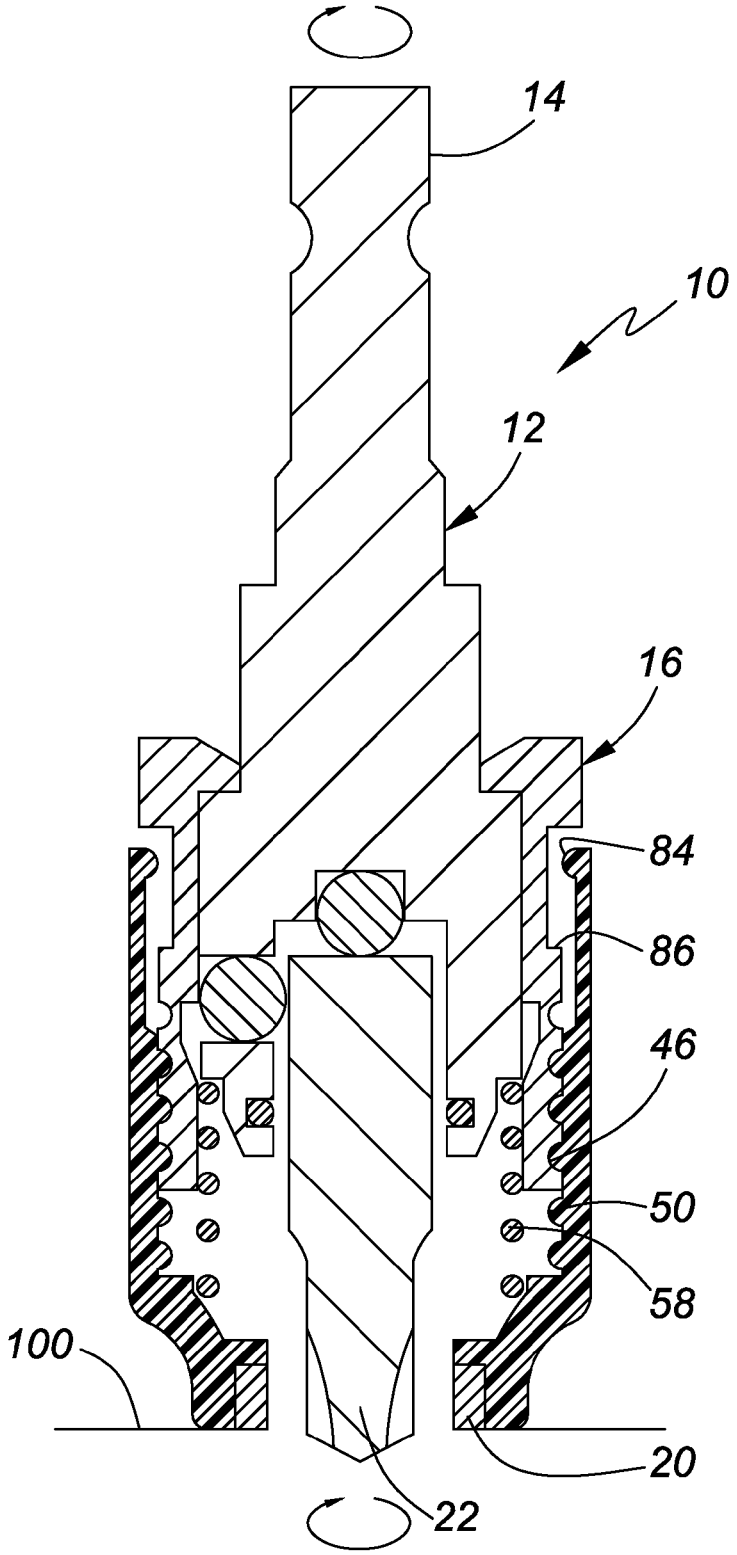
FIG. 7 is a cross-sectional view of the screw driving device shown in FIG. 4 in an adjusted position used to drive a screw to a depth different than a screw driven by the screw driving device shown in FIG. 4.

FIG. 7 is a cross-sectional view of the screw driving device 10 shown in FIG. 4 in an adjusted position used to drive a screw to a depth different than a screw driven by the screw driving device 10 shown in FIG. 4. The screw driving device 10 can be adjusted by gripping the hollow clutch sleeve 16 in one hand and the resilient depth adjustment sleeve 18 in the other hand and turning the resilient depth adjustment sleeve 18. In one embodiment, the pin thread 46 and the box thread 50 are left-hand threads, so turning the resilient depth adjustment sleeve 18 clockwise decreases a depth to which a screw is driven and turning the depth adjustment sleeve 18 counterclockwise increases a depth to which the screw is driven, though this is a matter of design choice. If the resilient depth adjustment sleeve 18 is turned too far, a stop lip 84 along an inner top edge of the resilient depth adjustment sleeve 18 engages a stop ledge 86 on an outer surface of the hollow clutch sleeve 16 to inhibit the box thread 50 from disengaging the pin thread 46.

Figure 8:
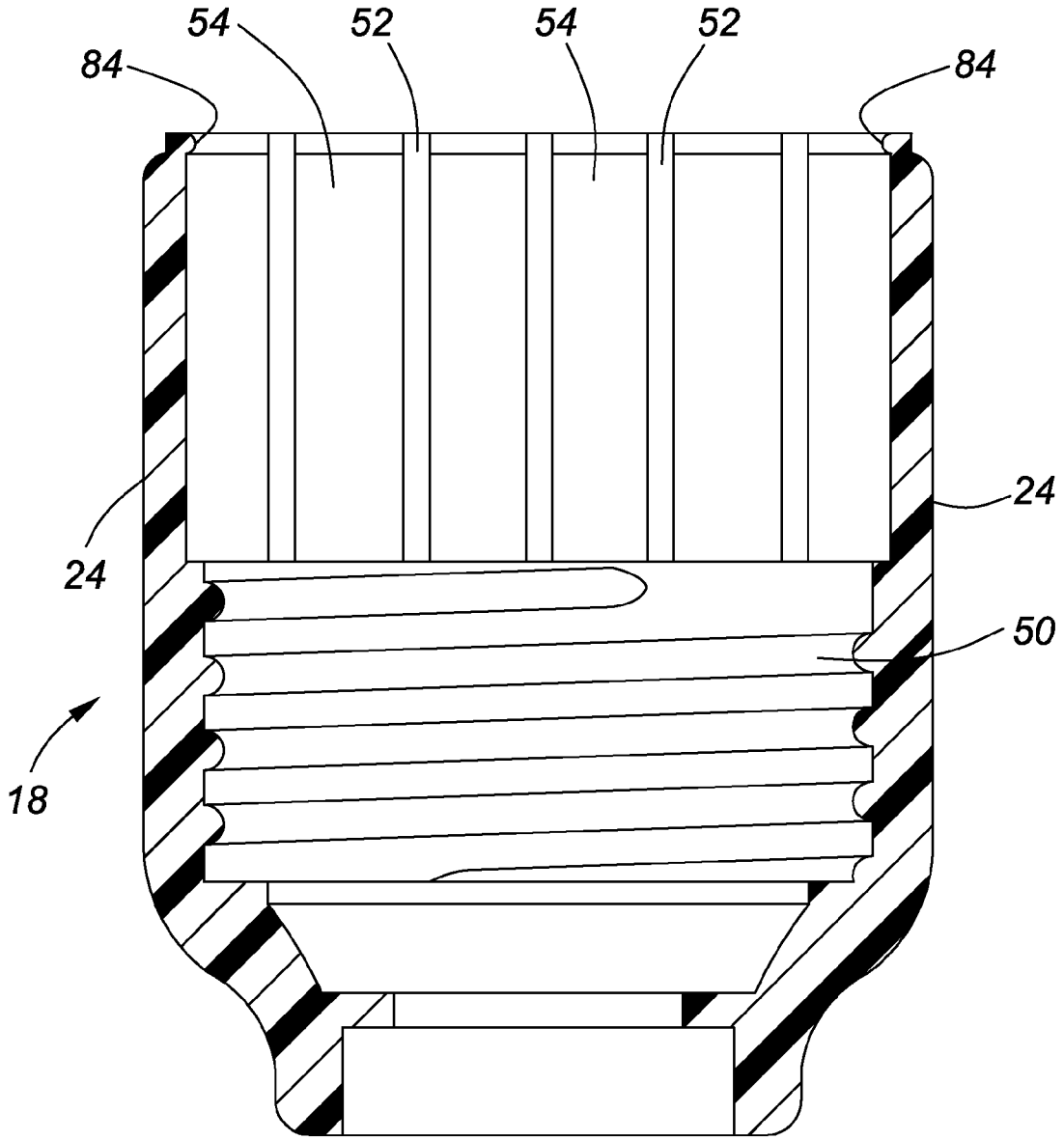
FIG. 8 is a cross-sectional view taken along lines 8-8 of a resilient depth adjustment sleeve shown in FIG. 3.

FIG. 8 is a cross-sectional view taken along lines 8-8 of a resilient depth adjustment sleeve 18 shown in FIG. 3. In one embodiment, the resilient depth adjustment sleeve 18 is an injection molded polyoxymethylene (POM) thermoplastic unitary body, which is resilient enough to permit manual adjustment but rigid enough to ensure that an adjusted position is not lost during normal use. As explained above with reference to FIG. 3, the interior surface of the resilient depth adjustment sleeve 18 above the box thread 50 is molded with elongated stop grooves 52. In one embodiment there are twelve elongated stop grooves 52, spaced 30° apart. As also explained above, the detent(s) 48 engage an elongated stop groove(s) 52 to retain the resilient depth adjustment sleeve 18 in any given angular position. In one embodiment, rotation of the resilient depth adjustment sleeve 18 by one elongated stop groove 52 achieves a depth adjustment of about 0.008", so very fine depth control is provided. The stop lip 84 engages the stop ledge 86 (see FIG. 7) to inhibit removal for the resilient depth adjustment sleeve 18 from the hollow clutch sleeve 16, as explained above with reference to FIG. 7.

The embodiments of the invention described above are intended to be exemplary only. The scope of the invention is therefore intended to be limited solely by the claims.

I claim:

1. A screw driving device with adjustable countersink depth, comprising:

a drive shaft having a drive end adapted to be engaged and driven by a power tool and a socket end with an annular wall that forms a socket which receives and retains a screw bit, the annular wall having a plurality of radial through bores which respectively receive a clutch ball bearing that engages the screw bit in a drive position and disengages the screw bit in a clutched position;

a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective clutch ball bearings when the drive shaft is in the clutched position so that the clutch ball bearings disengage the screw bit but remain captured in the respective radial through bores, and further having a pin thread on an outer surface of the bottom end and at least two spaced-apart detents located above the pin thread; and a resilient depth adjustment sleeve that surrounds the bottom end of the hollow clutch sleeve, the resilient depth adjustment sleeve having a bottom end with a passage through which the screw bit extends and a box thread above the passage that engages the pin thread on the hollow clutch sleeve, and further having a plurality of elongated stop grooves, each of the stop grooves being respectively sized to engage one of the detents on the outer surface to the hollow clutch sleeve, so that rotational force applied to the resilient depth adjustment sleeve deforms the resilient depth adjustment sleeve to permit ridges between the respective stop grooves to pass over the detents to change a depth to which a screw is driven by the screw bit before the drive shaft reaches the clutched position.

2. The screw driving device with adjustable countersink depth as claimed in claim 1 further comprising a compression coil spring that surrounds the screw bit and is captured between the socket end of the drive shaft and the bottom end of the resilient depth adjustment sleeve to urge the drive shaft towards the drive position.

3. The screw driving device with adjustable countersink depth as claimed in claim 1 further comprising a lock boss on a side of the drive shaft above the socket end.

4. The screw driving device with adjustable countersink depth as claimed in claim 3 further comprising at least one lock gap in the top end of the hollow clutch sleeve that permits the lock boss to pass through to lock the screw bit in a reverse drive position when the lock boss is passed through the lock gap and the hollow clutch sleeve is rotated far enough to capture the lock boss within an interior of the hollow clutch sleeve.

5. The screw driving device with adjustable countersink depth as claimed in claim 4 further comprising spaced-apart axial ridges on an outer surface of the resilient depth adjustment sleeve to provide a grip for rotating the resilient depth adjustment sleeve.

6. The screw driving device with adjustable countersink depth as claimed in claim 5 wherein the bottom end of the resilient depth adjustment sleeve is smaller than the top end of the resilient depth adjustment sleeve.

7. The screw driving device with adjustable countersink depth as claimed in claim 6 wherein the spaced apart axial ridges extend a full length of the top end of the resilient depth adjustment sleeve provide the grip for rotation of the resilient depth adjustment sleeve.

8. The screw driving device with adjustable countersink depth as claimed in claim 6 wherein at least some of the spaced apart axial ridges extend from a bottom of the top end of the resilient depth adjustment sleeve but terminate at a bottom of respective short slots in a top of the resilient depth adjustment sleeve, which slots increase a resilience of the resilient depth adjustment sleeve.

9. The screw driving device with adjustable countersink depth as claimed in claim 1 wherein the bottom end of the resilient depth adjustment sleeve comprises a socket that surrounds the passage through which the screw bit extends, the socket receiving and retaining a doughnut shaped magnet that retains a screw on a bottom end of the screw bit when the drive shaft is in the drive position.

10. The screw driving device with adjustable countersink depth as claimed in claim 1 further comprising an annular groove in a bottom interior of the socket end of the drive shaft, the annular groove accepting a circlip that engages the screw bit to releaseably retain the screw bit in the socket end of the drive shaft.

11. The screw driving device with adjustable countersink depth as claimed in claim 1 wherein the box thread and the pin thread are left-hand threads.

12. The screw driving device with adjustable countersink depth as claimed in claim 1 wherein the resilient depth adjustment sleeve comprises polyoxymethylene (POM).

13. A screw driving device with adjustable countersink depth, comprising:

a drive shaft having a drive end adapted to be engaged and driven by a power tool and a socket end with an annular wall that forms a socket which receives and retains a screw bit, the annular wall having a plurality of radial through bores which respectively receive a clutch ball bearing that engages the screw bit in a drive position and disengages the screw bit in a clutched position to permit the screw bit to rotate freely with respect to the drive shaft in the clutched position;

a hollow clutch sleeve having a top end, a bottom end and a central passage that receives the drive shaft, a top end of the central passage being sized to permit the drive end of the drive shaft to pass there through, but not permit the socket end of the drive shaft to pass there through, the hollow clutch sleeve having an annular groove in a bottom end of the central passage sized to receive the respective clutch ball bearings when the drive shaft is in the clutched position so that the clutch ball bearings disengage the screw bit but remain captured in the respective radial through bores, and further having a pin thread on an outer surface of the bottom end and a detent located above the pin thread;

a resilient depth adjustment sleeve that surrounds the bottom end of the hollow clutch sleeve, the resilient depth adjustment sleeve having a bottom end with a passage through which the screw bit extends and a box thread above the passage that engages the pin thread on the hollow clutch sleeve, and further having a plurality of elongated stop grooves respectively sized to engage the detent on the outer surface to the hollow clutch sleeve, so that rotational force applied to the resilient depth adjustment sleeve deforms the resilient depth adjustment sleeve to permit ridges between the stop grooves to pass over the detents to change a depth to which a screw is driven by the screw bit before the drive shaft reaches the clutched position; and a compression coil spring between the bottom end of the resilient depth adjustment sleeve and a bottom end of the drive shaft, the compression coil spring surrounding the screw bit and urging the drive shaft to the drive position.

* * * * *